US009724254B2

(12) United States Patent
Cole

(10) Patent No.: US 9,724,254 B2
(45) Date of Patent: Aug. 8, 2017

(54) ADJUSTABLE BED

(71) Applicant: Daryl L. Cole, Caryville, TN (US)

(72) Inventor: Daryl L. Cole, Caryville, TN (US)

( * ) Notice: Subject to any disclaimer, the term of this patent is extended or adjusted under 35 U.S.C. 154(b) by 383 days.

(21) Appl. No.: 14/505,982

(22) Filed: Oct. 3, 2014

(65) Prior Publication Data

US 2016/0095772 A1 Apr. 7, 2016

(51) Int. Cl.

*A61G 7/015* (2006.01)
*A61G 7/018* (2006.01)
*A61G 7/00* (2006.01)

(52) U.S. Cl.

CPC ..... *A61G 7/001* (2013.01); *A61G 7/015* (2013.01); *A61G 7/018* (2013.01); *A61G 2200/16* (2013.01)

(58) Field of Classification Search

CPC ..... A61G 7/002; A61G 7/008; A61G 7/015; A61G 13/02; A61G 13/04; A61G 13/08; A61G 17/001; A61G 17/018; A47C 17/64; A47C 17/66; A47C 17/70; A47C 17/74; A47C 19/04; A47C 19/12; A47C 19/122; A47C 19/124; A47C 19/126; A47C 20/16; A47C 20/046; A47C 1/025; A47C 17/162; A47C 17/17

See application file for complete search history.

(56) References Cited

U.S. PATENT DOCUMENTS 385,311 A 6/1888 Judy et al.
1,269,868 A 6/1918 Sinjem
2,113,286 A * 4/1938 White ..... A47C 20/043 5/607
2,197,304 A 4/1940 Haynes
2,873,457 A 2/1959 Joy
3,013,281 A 12/1961 Steiner
3,493,979 A 2/1970 Koll et al.
3,609,357 A * 9/1971 Jones ..... A61B 6/04 378/209
3,875,598 A 4/1975 Foster et al.
4,225,988 A * 10/1980 Cary ..... A61G 7/015 5/607
4,658,450 A 4/1987 Thompson
(Continued)

FOREIGN PATENT DOCUMENTS

DE 10141491 A1 3/2003
WO 9613239 5/1996
WO 2009140173 A1 11/2009

*Primary Examiner* — Nicholas Polito
*Assistant Examiner* — Rahib Zaman
(74) *Attorney, Agent, or Firm* — Luedeka Neely Group, P.C.

(57) ABSTRACT

An adjustable bed having two bedframe halves and a gear hinge assembly for simultaneously translating the bedframe halves and for rotating one bedframe half. The gear hinge assembly is mounted to a carrier assembly that provides lateral movement and causes the bedframe halves to move from side to side. The gear hinge assembly includes an arm mounted to each bedframe half and a pair of nested cups, including gears, which are mounted to one of the arms. A pair of offset gear tracks interact with one of the gears at a time to cause the gear to rotate. When the gear rotates, the arm connected to the gear also rotates. The rotation of one arm and bedframe half occurs simultaneously with the translation of both bed halves.

16 Claims, 9 Drawing Sheets

(56) References Cited

U.S. PATENT DOCUMENTS 4,658,451 A 4/1987 Taniguchi
4,678,229 A * 7/1987 Ryan ..... A47C 1/0248 248/408
4,756,034 A * 7/1988 Stewart ..... A47C 17/1756 5/37.1
5,038,423 A * 8/1991 Hall ..... A47C 17/1756 5/18.1
5,125,122 A 6/1992 Chen
5,208,928 A 5/1993 Kuck et al.
5,224,228 A 7/1993 Larrimore
5,479,665 A * 1/1996 Cassidy ..... A61G 7/001 5/609
5,535,464 A * 7/1996 Salonica ..... A61G 7/02 5/604
5,640,729 A * 6/1997 Marino ..... A61G 7/001 5/607
5,699,566 A * 12/1997 Chuang ..... A61G 7/001 5/613
5,860,899 A 1/1999 Rassman
6,038,717 A 3/2000 Persson
6,212,712 B1 * 4/2001 Topp ..... A61G 1/04 5/509.1
6,249,695 B1 6/2001 Damadian
6,385,801 B1 5/2002 Watanabe et al.
6,651,281 B1 11/2003 Figiel
6,817,363 B2 11/2004 Biondo et al.
7,140,055 B2 11/2006 Bishop et al.
7,234,179 B2 6/2007 Shaw
7,237,286 B1 * 7/2007 Kim ..... A47C 20/041 5/613
7,246,389 B2 * 7/2007 Taguchi ..... A61G 7/001 5/608
7,296,312 B2 11/2007 Menkedick et al.
7,343,635 B2 * 3/2008 Jackson ..... A61G 7/001 5/607
7,426,759 B2 9/2008 Donaldson
7,712,168 B2 5/2010 Kim
7,716,761 B1 * 5/2010 Gilstad ..... A61G 7/0573 5/425
7,716,762 B2 5/2010 Ferraresi et al.
7,761,942 B2 7/2010 Benzo et al.
7,845,034 B2 * 12/2010 Kim ..... A61G 7/015 5/608
8,042,208 B2 10/2011 Gilbert et al.
8,056,164 B2 11/2011 Benzo et al.
8,171,582 B1 5/2012 Nikolaev et al.
8,601,618 B2 * 12/2013 Benzo ..... A61G 7/015 5/37.1
2001/0032363 A1 * 10/2001 Elliott ..... A47C 20/041 5/618
2005/0166323 A1 * 8/2005 Kawakami ..... A61G 7/001 5/610
2005/0262635 A1 12/2005 Wing
2006/0026762 A1 * 2/2006 Hornbach ..... A47C 19/045 5/611
2007/0143924 A1 6/2007 Guo
2007/0169266 A1 7/2007 Kim
2008/0216240 A1 9/2008 Valli
2008/0222811 A1 * 9/2008 Gilbert ..... A61G 13/04 5/607
2009/0013469 A1 * 1/2009 Johnson ..... A61G 7/0573 5/612
2009/0077748 A1 * 3/2009 Kim ..... A47C 19/04 5/613
2009/0094745 A1 4/2009 Benzo et al.
2009/0183308 A1 * 7/2009 Roma ..... A47C 17/1753 5/37.1
2010/0275376 A1 11/2010 Benzo et al.
2010/0313353 A1 * 12/2010 Ferraresi ..... A61G 7/1019 5/84.1
2012/0036637 A1 2/2012 Wang et al.
2014/0237723 A1 * 8/2014 Wysocki ..... A61G 7/015 5/613
2014/0325759 A1 * 11/2014 Bly ..... A61G 7/002 5/611

* cited by examiner

ADJUSTABLE BED

FIELD

The present disclosure relates to the field of adjustable beds. Specifically, the present disclosure relates to an adjustable bed that facilitates rolling a user over.

BACKGROUND

Adjustable beds may be used to reposition a user within a bed to a desired position. However, adjustable beds typically do not assist in rolling a user completely over, either by rolling a user from lying on their back to lying on their front, or vice versa. Additionally, while some adjustable beds may assist a user in rolling over, the range of motion of the typical adjustable bed is small and often insufficient to fully roll a user over.

An adjustable bed capable of rolling a user completely over is particularly useful in hospitals and other caregiving industries. Typically to roll an incapacitated patient over, such as to provide a bath or provide other care, a nurse or caregiver must physically push or pull the patient to manipulate them into the desired position. This may be problematic when a patient is overweight or obese, as injuries may result to the nurse or caregiver as a result of manipulating a patient within a bed.

In fact, it has been found that caring for obese patients poses a substantial challenge to hospitals and health care workers. Due to a greater number of obese patients, a sharp increase in workplace related injuries to health care workers has been observed. Common injuries suffered as a result by health care workers include back injuries as a result of lifting obese patients.

Additionally, obese or incapacitated patients are often dependent on having health care workers assist them in rolling over or repositioning themselves in a bed, and the patients are incapable of rolling themselves over when alone.

What is needed, therefore, is an adjustable bed that facilitates the rolling over and repositioning of a patient.

BRIEF DESCRIPTION OF THE DRAWINGS

Further advantages of the disclosure are apparent by reference to the detailed description when considered in conjunction with the figures, which are not to scale so as to more clearly show the details, wherein the reference numbers indicate like elements throughout the several views, and wherein.

DETAILED DESCRIPTION

Figure 1A:
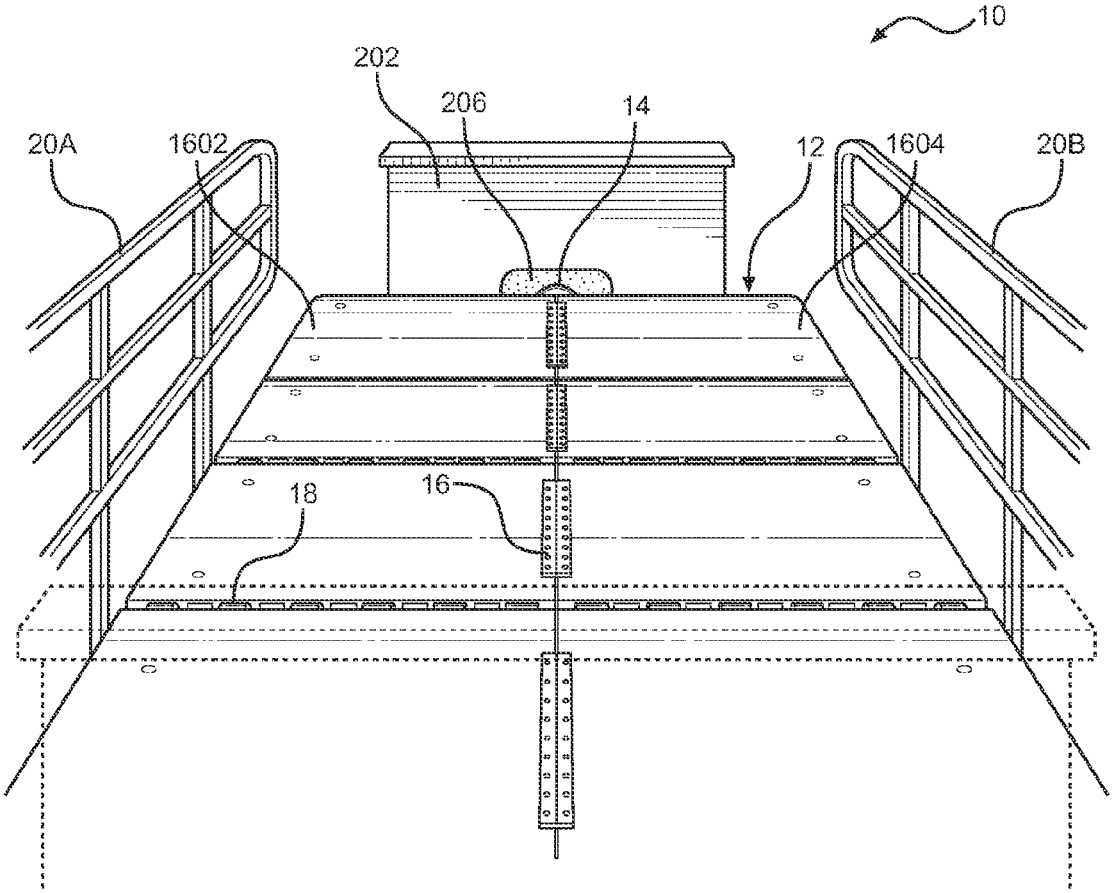
FIG. 1A is a perspective view of an adjustable bed according to one embodiment of the present disclosure.
Figure 1B:
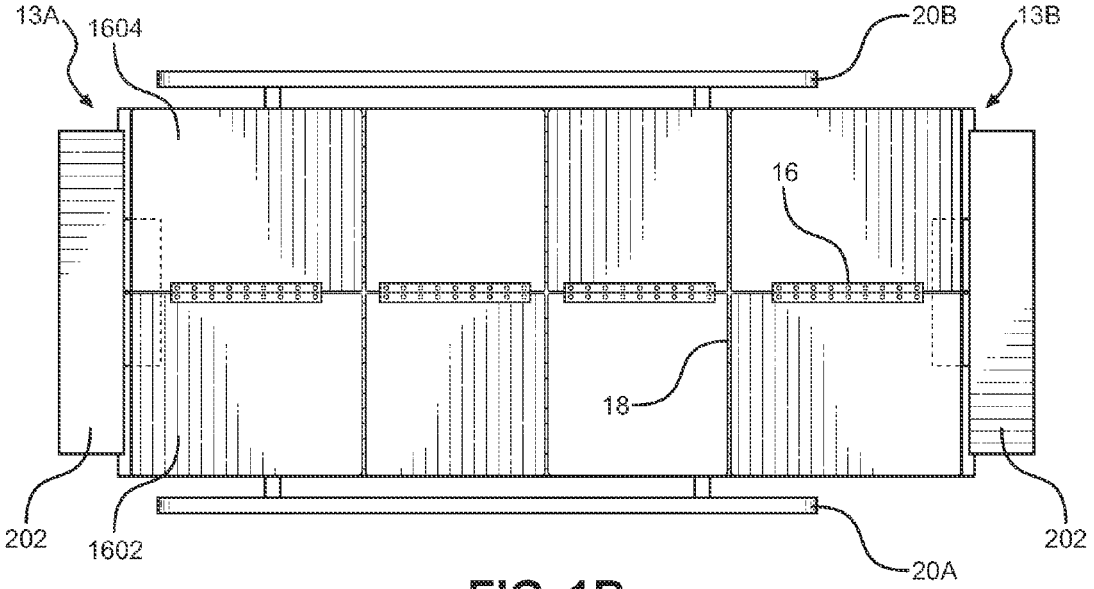
FIG. 1B is an overhead view of the adjustable bed shown in FIG. 1A.

With initial reference to FIGS. 1A and 1B, the present disclosure provides an adjustable bed 10 including a bed platform 12 having a first end 13A and a second end 13B and one or more gear hinge assemblies 14. In the description that follows, the term "user" or "occupant" is used to refer to a person occupying the adjustable bed 10. Also, the term "bedframe half" is used to refer to one half of the bed platform 12, including panels that are discussed below. It should be understood that "bed platform" or "bed surface" refers not only to a hospital-type bed as exemplified in the figures herein, but to other similar surfaces as well in which a user rests such as a futon, daybed, chairs, benches, etc.

The bed platform 12 is divided into first and second bedframe halves 1602, 1604 by an axis that extends between the first and second ends 13A, 13B. The two halves 1602, 1604 are connected together by one or more longitudinal hinges 16 extending along an axis between the first end 13A and the second end 13B of the bed platform 12. As discussed in detail below, a gear hinge assembly 14 enables each bedframe half 1602, 1604 to rotate independently with respect to the other bedframe half. Additionally, simultaneously with the above-described rotation of bed halves 1602, 1604 the gear hinge assembly 14, enables both bed halves to translate at the same time from side-to-side. Preferably, a gear hinge assembly 14 is disposed at each of the first and second ends 13A, 13B of the bed platform 12.

Figure 2:
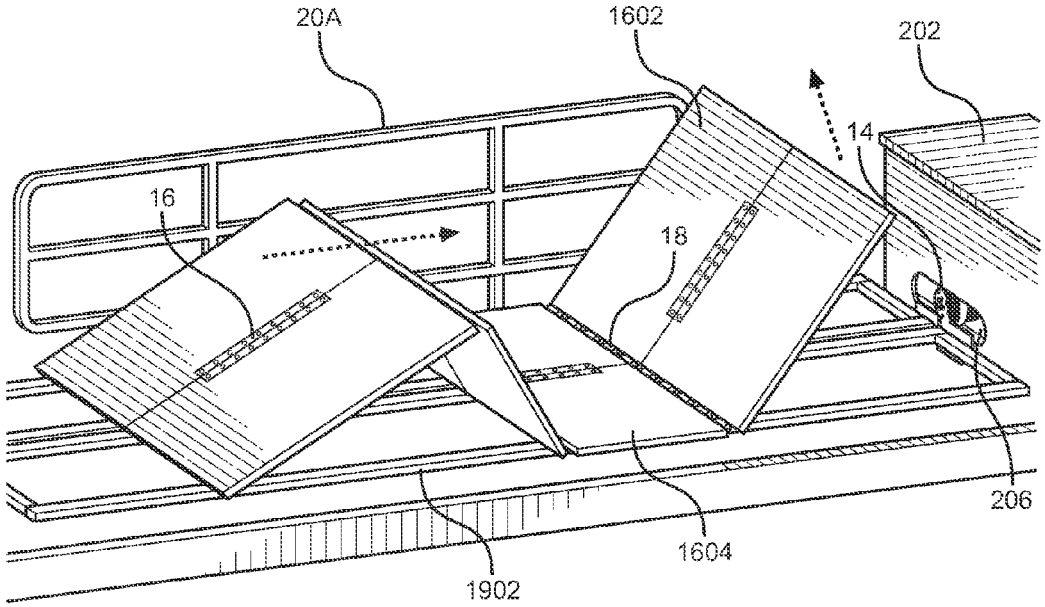
FIG. 2 is a perspective view of the adjustable bed in FIG. 1A shown with leg and torso portions in a raised position.
Figure 3:
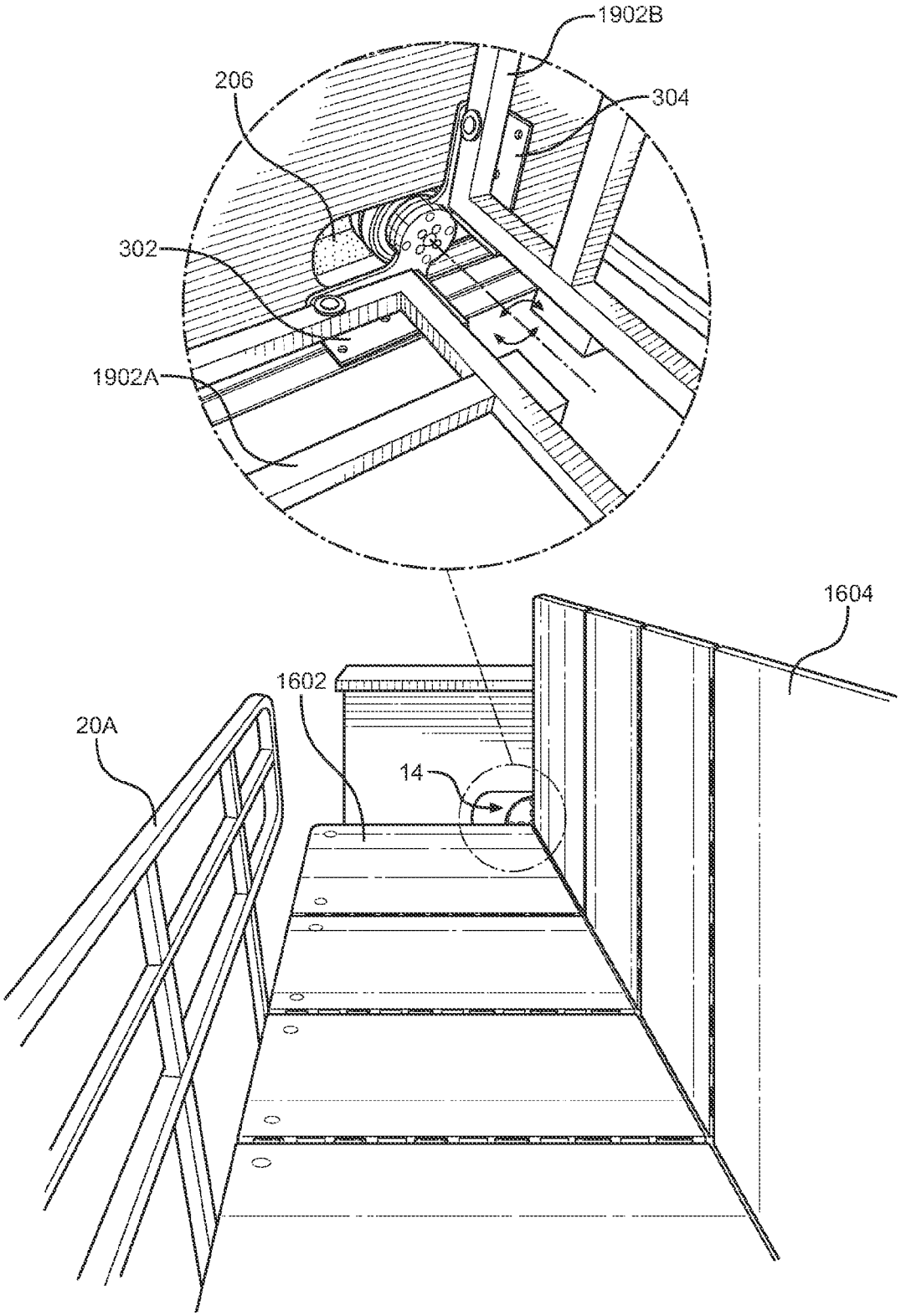
FIG. 3 is a perspective view depicting an adjustable bed having a right bedframe half in a raised position.

As shown in FIGS. 2 and 3, in certain embodiments, the bedframe halves 1602, 1604 are mounted to a bed frame assembly 1902 that is secured to the gear hinge assembly 14. However, in other embodiments, an underlying frame is not required and the gear hinge assembly 14 may be mounted to the bedframe halves 1602, 1604 directly. When sufficient framing assembly is provided, one or more lateral hinges 18 extending crosswise across the bed platform 12 may be provided, which, enable an user's torso or legs to be repositioned.

In the detail view of FIG. 3, the bedframe halves have been removed and the underlying bed frame assembly 1902 is shown. To enable the rotation of the bedframe halves, the bed frame assembly 1902 preferably includes first and second panels 1902A, 1902B. The first bedframe half 1602 is mounted to the first panel 1902A and the second bedframe half 1604 is mounted to the second panel 1902B. The frame 1902 is supported by arms that are part of the gear hinge assembly 14. In particular, a first arm 302 is mounted to a portion of the first panel 1902A and a second arm 304 is mounted to a portion of the second panel 1902B. The function and structure of the arms 302, 304 are discussed below.

With reference again to FIG. 1A, the bed 10 includes a pair of railings 20A and 20B disposed on either side of the bed platform 12, which assist in preventing an occupant from rolling off of the bed. The adjustable bed 10 is configured to assist in repositioning an occupant of the bed and in rolling the occupant of the bed partially or completely over. To facilitate rolling the user, the bed platform 12 is capable of both pivoting and sliding laterally (i.e., from side to side). Preferably, the rotational and lateral movement occurs simultaneously. The bed platform 12 pivots about the longitudinal hinge 16. Preferably, the first bedframe half 1602 pivots about the hinge 16 while the second bedframe half 1604 remains stationary, and vice versa. Additionally, while the bed platform 12 pivots, the adjustable bed 10 moves in a lateral side-to-side manner to further encourage a user to roll over.

Figure 4A:
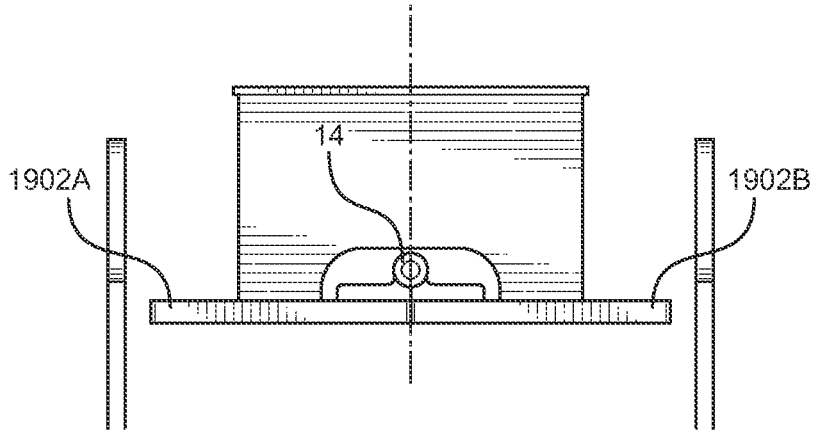
FIG. 4A-4C depicts an adjustable bed translating towards the right while the right bedframe half simultaneously rotates upwards.
Figure 4B:
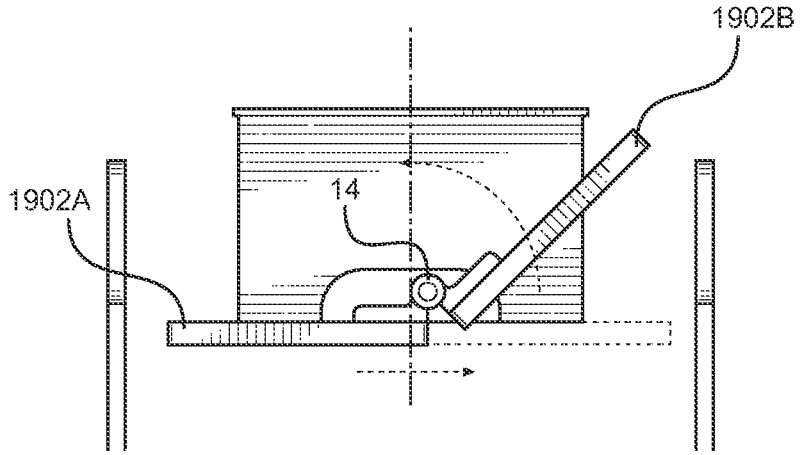
Figure 4C:
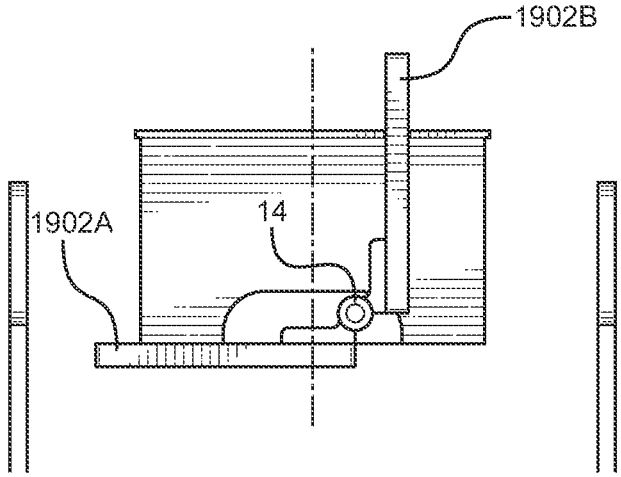

With reference to FIGS. 4A-4C, the bedframe halves have been removed and the underlying bed frame assembly 1902 is shown. In this view, it can be seen that the hinge assembly 14 is mounted to the first and second panels 1902A, 1902B. The bed halves are then mounted onto the top of the first and second panels. These figures illustrate the simultaneously translation of the bed platform to the right and rotation of the second panel 1902B upwards. As the bed platform translates left, the second panel would rotate downwards until it reached the neutral position shown in FIG. 4A. If the bed platform were translated further to the left, the first panel 1902A would begin to rotate upwards.

Referring again to FIG. 1A, in use, a user is placed into the center of the bed 10 on top of the two bed halves 1602, 1604. The combination of lateral movement and pivoting movement of the bed platform 12 induces a rolling motion to gently roll a user over partially or completely. In particular, one of the user's shoulders is raised by the rotating bedframe half while the other shoulder turns under the user's body to facilitate the turning action. The user may be rolled completely over (i.e., from a face down position to a face up position). Alternatively, the user may be partially rolled over onto one shoulder or onto the other shoulder. An added benefit of this design is that the simultaneous rolling and translating movements assist in preventing the user's shoulder from "digging in" to the bed mattress, which may cause discomfort or injury.

Figure 5:
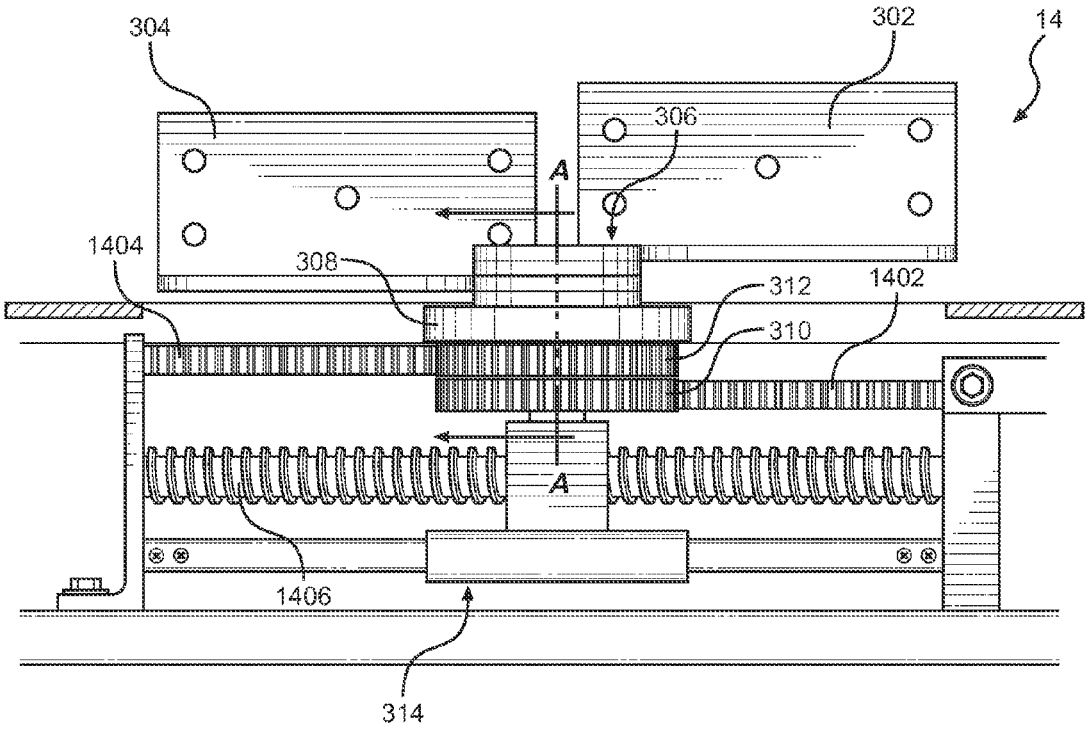
FIG. 5 is an overhead view depicting a gear assembly according to one embodiment of the present disclosure.
Figure 9:
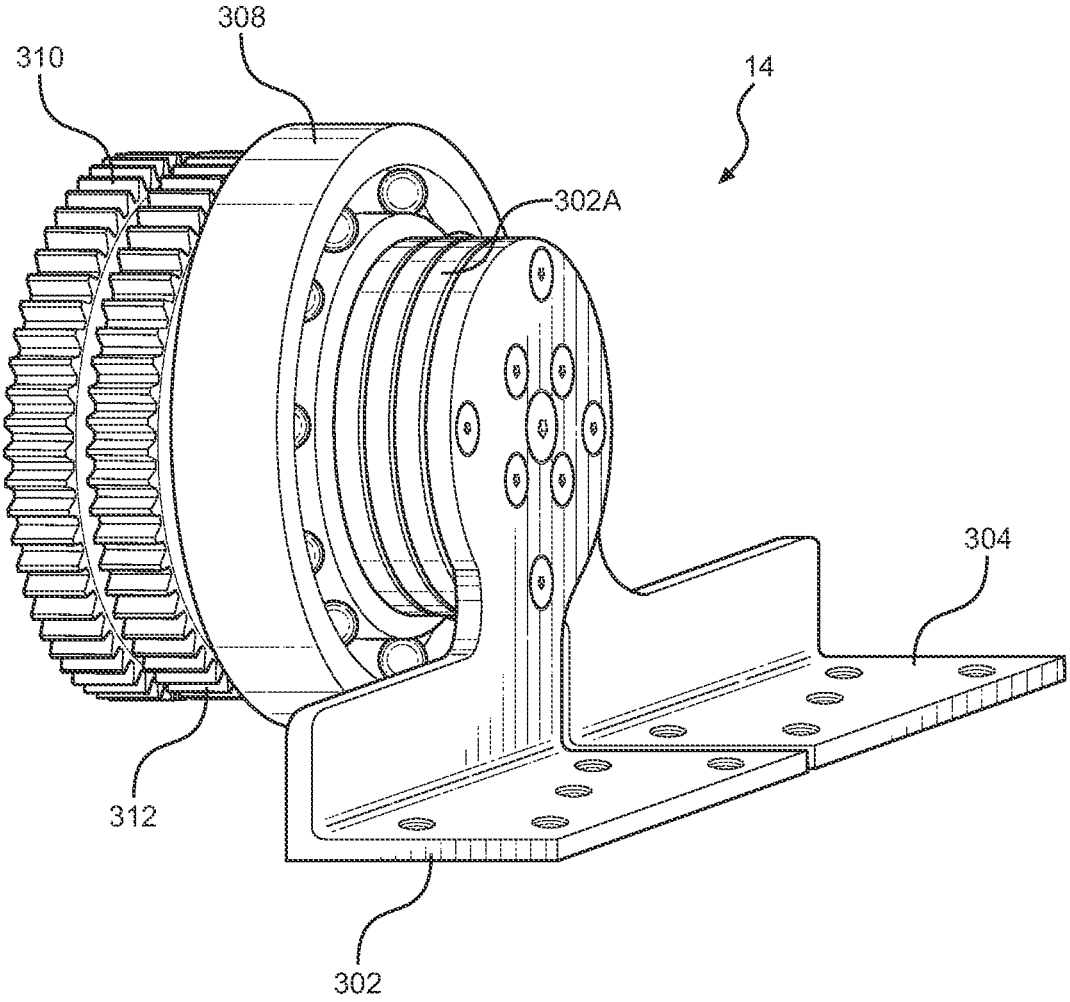
FIG. 9 is a perspective view depicting the gears, cups and arms of a gear assembly according to one embodiment of the present disclosure in an assembled state.

The gear hinge assembly 14, which produces the lateral and rotational movement, is located within a housing 202. The housing 202 includes an elongate lateral aperture 206 through which the gear hinge assembly 14 is secured to the bed platform 12. FIGS. 5 and 9 show a gear hinge assembly 14 according to one embodiment of the present disclosure. The gear hinge assembly 14 sometimes includes a first arm 302, a second arm 304, a cup assembly 306, a carrier bearing 308, a first gear 310, a second gear 312, a first gear track 1402, a second gear track 1404, a worm gear 1406, and a guide assembly 314. Each of these components will be discussed in turn below, beginning with a discussion of the gears and followed by discussions of the arms and cups.

The gears 310, 312 are moved leftward and rightward by the guide assembly 314. The guide assembly 314 is mounted to the worm gear 1406 and also mates with the gears 310, 312 and cup assembly 306. As the worm gear 1406 rotates, such as by a motor 701 mated to the worm gear, the guide assembly 314 travels laterally (i.e., left or right) along the worm gear, depending on the direction the worm gear is turned. This lateral movement causes the gears 310, 312 and cup assembly 306 to also move laterally, thus providing the lateral movement of the gear assembly 14. However, it may be appreciated that achieving the above-described lateral movement does not necessarily require a motor and worm gear combination. Other similar components could replace the motor 701, worm gear 1406, or both, including for example a hand crank, a pneumatic or hydraulic pump, a pulley, or other similar device.

As the gear assembly 14 continues to move either left or right, one of the gears 310, 312 interacts with one of the gear tracks 1402, 1404. The gear tracks 1402, 1404 are offset from one another. One advantage of having offset tracks is that only one gear can interact with each track and also the gears can operate independently of one another. In this particular view, if the gear assembly 14 moves rightward, the first gear 310 will interact with the first gear track 1402. As discussed in greater detail below, the first gear 310 is mated with the first arm 302, and when the first gear turns the first arm is either raised or lowered. In a similar fashion, if the gear assembly 14 in this view moves leftward, the second gear 312 would interact with the second gear track 1404 and would cause the second arm 304 to be raised or lowered. Thus, providing the rotational movement of the gear assembly 14, which in turn rotates the bed halves upwards and downwards.

Figure 6:
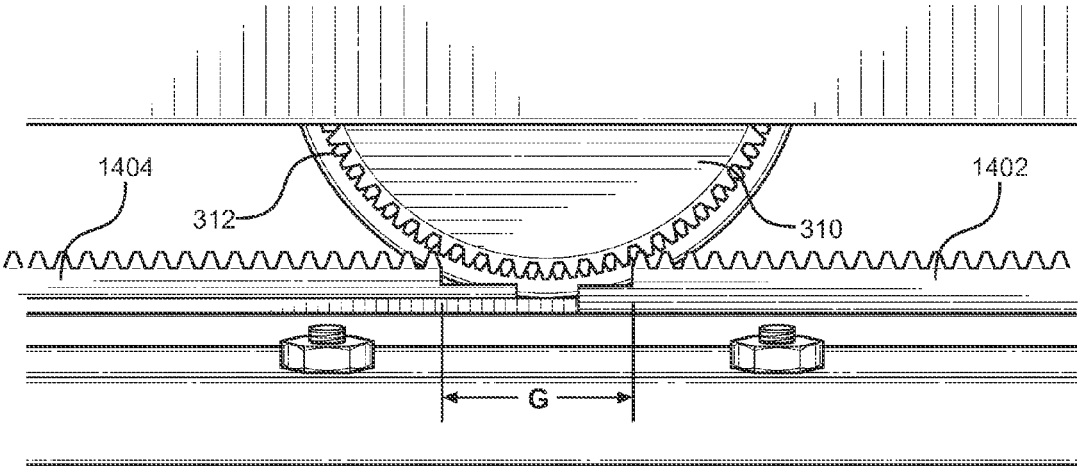
FIG. 6 is an elevation view depicting gears tracks and gears in a neutral position in a gear assembly according to one embodiment of the present disclosure.

As shown in FIG. 6, a gap G is provided between the first track 1402 and second track 1404, creating a neutral position, wherein neither the first gear 310 nor the second gear 312 are engaged with the first gear track 1402 or the second gear track 1404. This neutral position enables the bed platform 12 to translate from side to side for a certain distance while the bedframe halves remain flat. The distance that the bed platform 12 may translate before the gears engage the track may be adjusted by adjusting the gap G. For example, the engagement may occur (and rotation begin) nearly immediately upon translation, as shown in FIGS. 4A-4C, by having a small gap. Alternatively, a delay may be provided between the time the bed begins translating and the time the bedframe half begins rotating by providing a larger gap.

Figure 7:
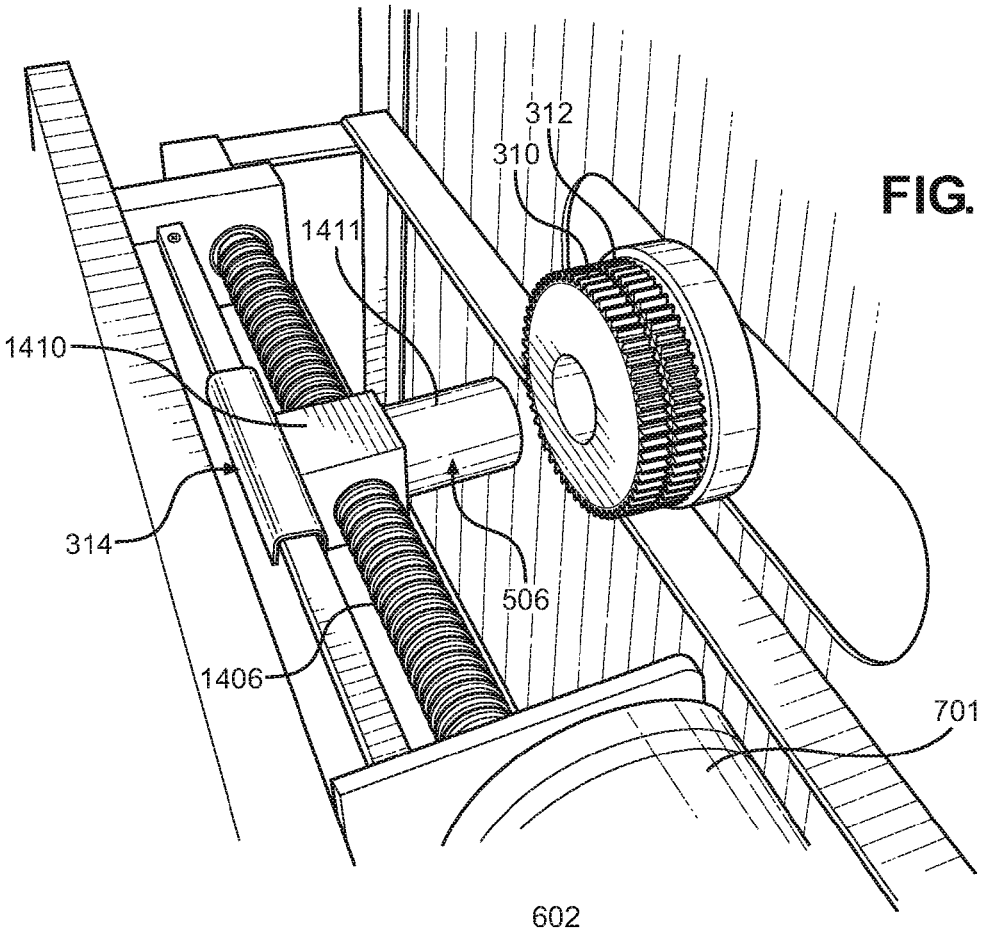
FIG. 7 is a perspective view depicting a gear assembly inside of a housing according to one embodiment of the present disclosure.
Figure 8:
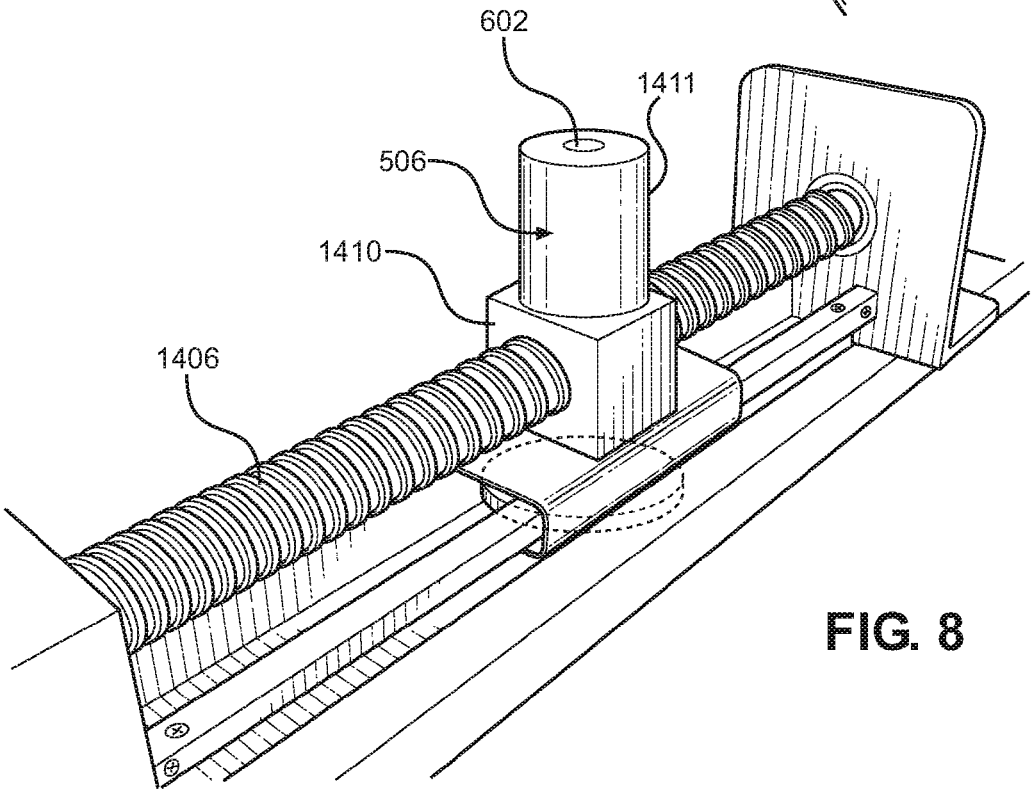
FIG. 8 is a perspective view of a worm gear and carrier bushing of a gear assembly according to one embodiment of the present disclosure.

FIG. 5 illustrates the gear hinge assembly 14 where the guide assembly 314 is inserted into the gears 310,312 in an operation-ready configuration. In FIGS. 7 and 8, the guide assembly 314 has been removed from the gears 310, 312, in a tear-down or maintenance configuration. As shown in these views, the guide assembly 314 includes a worm gear carrier 1410 that mounts to and translates along the worm gear 1406. In particular, the worm gear carrier 1410 includes a threaded opening that is configured to be threadably engaged with the worm gear 1406 such that rotation of the worm gear attached to the motor induces lateral movement of the worm gear carrier. As the worm gear carrier 1410 moves laterally, the gear assembly 306 also moves laterally.

A carrier bushing 506, an elongate cylinder having a stem 1411 provided with a threaded bore 602 formed at a distal end thereof, extends from the worm gear carrier 1410 and is configured for insertion into the gears 310, 312 and cup assembly (not shown). As the worm gear carrier 1410 moves laterally, the stem 1411 forces the gears 310, 312 to move laterally at the same time.

The worm gear 1406 may be rotated in a clockwise or counter-clockwise direction, depending on the desired direction of movement of the adjustable bed 10. In particular, when the worm gear 1406 rotates in a clockwise direction, the worm gear carrier 1410 and cup assembly 306 attached thereto move in a first lateral direction (e.g., leftwards). Alternatively, when the worm gear 1406 rotates in a counterclockwise direction, the worm gear carrier 1410 and cup assembly 306 moves in a second lateral direction (e.g., rightwards).

Figure 10:
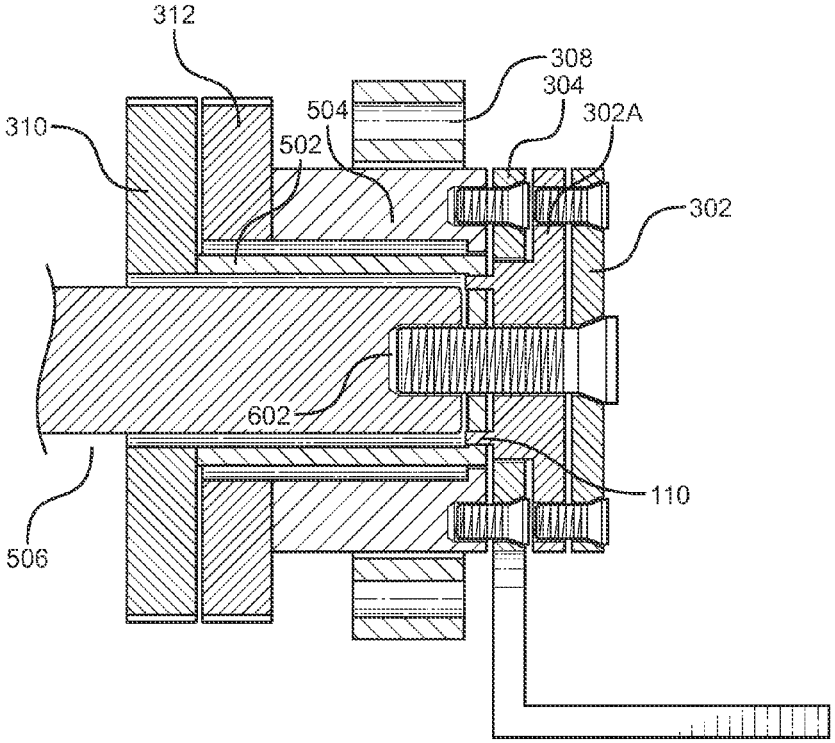
FIG. 10 is a sectional view of a portion of the gear assembly in FIG. 5 shown along line A-A.

As shown in FIGS. 9 and 10, the gears 310, 312 are mounted to one side of the cup assembly 306 and the arms are mounted to the other side. The structure and operation of the gears was provided above. The following discussion relates to the arms and then the cup assembly.

Figure 12:
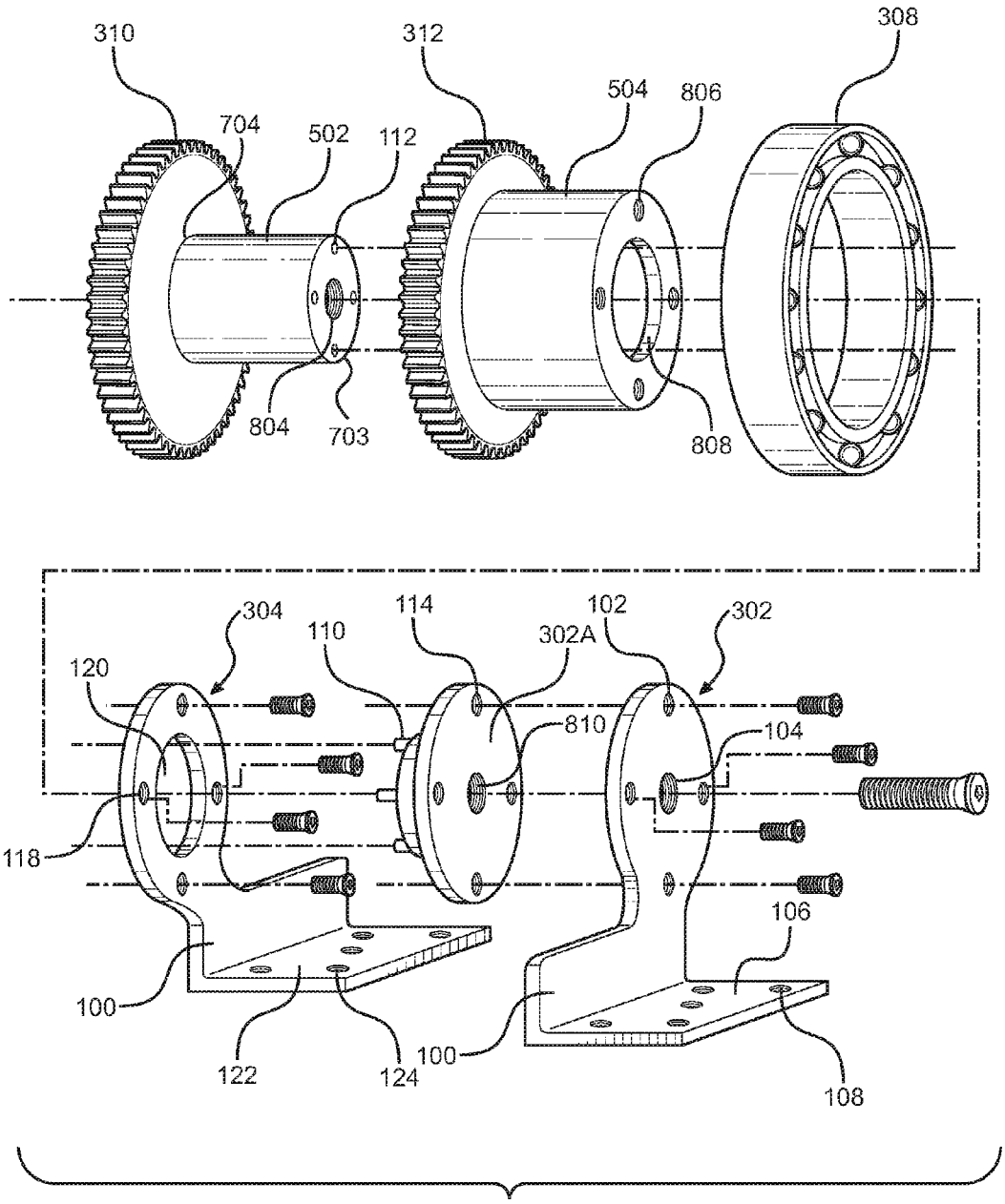
FIG. 12 is an exploded view of a portion of a gear assembly, including gears, cups, and bearing, according to one embodiment of the present disclosure.

With reference to FIG. 12, in this particular embodiment, the first arm 302 is L-shaped and includes a vertical cup mounting surface 100 having a shoulder connected to a hub having a perimeter. There are a plurality of outer openings 102 in the hub that are adjacent to the perimeter. Additionally, a first aperture 104 is centrally located in the hub. A horizontal platform mounting surface 106 extends substantially orthogonally away from a bottom edge of the vertical cup mounting surface, which has a plurality of openings 108 disposed therein. The second arm 304 is substantially identical in appearance to the first arm 302 and includes a plurality of outer openings 118 adjacent to the perimeter of the hub. A second aperture 120, larger than the first aperture 104 of the first arm 302, is centrally located in the hub. A horizontal platform mounting surface 122 extends substantially orthogonally away from a bottom edge of the vertical cup mounting surface, which has a plurality of openings 124 disposed therein. As shown best in the detail view of FIG. 3, the bedframe halves 1602, 1604 are mounted to the horizontal platform mounting surfaces 106, 122.

Figure 11:
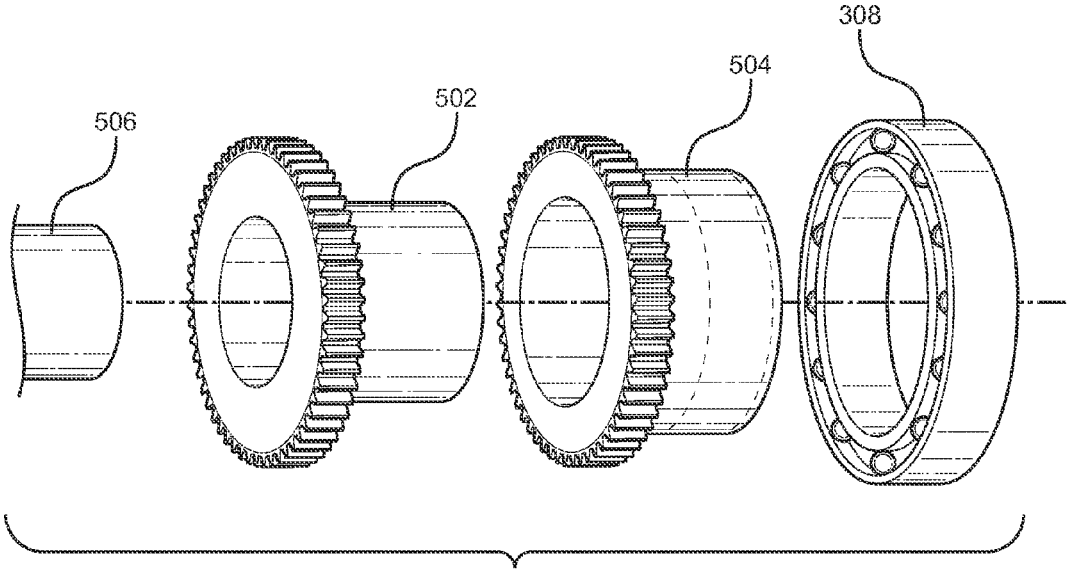
FIG. 11 is an exploded view showing first and second cups and a bearing of a gear assembly according to one embodiment of the present disclosure.

Now, with reference to FIGS. 10-12, the cup assembly 306 includes a first cup 502 that is nested within a second cup 504. The first cup 502 is formed of a hollow elongate cylinder having a distal end 703 and a proximal end 704. The distal end 703 of the first cup 502 includes one or more openings 112 and a first central aperture 804 extending into a hollow interior of the first cup. In some embodiments, the first gear 310 is mounted onto the proximal end 704 of the first cup 502. In alternative embodiments, the first gear 310 and first cup 502 are formed as a single component, with the first gear 310 being machined on the first cup 502.

The second cup 504 is also formed of an elongate hollow cylinder having proximal and distal ends. Similarly, a distal end of the second cup 504 is secured to the second arm 304. The distal end of the second cup 504 includes one or more openings 806 and a second central aperture 808 extending into a hollow interior of the second cup. In certain embodiments, the second gear 312 is mounted onto the proximal end of the second cup 504. In an alternative embodiment, the second gear 312 and second cup 504 are formed from a single piece of material.

To reduce friction between the gear assembly and the housing as the gear assembly translates from side to side, a bearing 308 is snuggly slid over the outside of the cup assembly 306. The bearing 308 contacts the housing as the gear assembly 14 translates.

The first cup 502, second cup 504, bearing 308 and carrier bushing 506 are configured to be concentrically aligned along a central axis aligned with the center of the gear hinge assembly 14. The first cup 502 is configured to have an outer diameter that is less than an inner diameter of the hollow second cup 504, such that the first cup 502 may be slidably engaged within the hollow cylindrical second cup 504. First cup 502 and second cup 504 are configured such that the tolerance between the outer diameter of the first cup 502 and the inner diameter of the second cup 504 is relatively close to prevent excessive lateral movement. However, the diameters of the first cup 502 and second cup 504 are sufficiently different to allow the cups to independently move with respect to one another. Further, a lubricant may be applied between the first cup 502 and the second cup 504 to further encourage independent rotation of the cups. As shown best in FIG. 10, when the first cup 502 is inserted into the second cup 504, the outside surface of the distal end of the first cup contacts and is held in place by the inside surface of the distal end of the second cup.

The distal end of the first cup 502 is configured to be secured to the first arm 302 and the distal end of the second cup 504 is configured to be secured to the second arm 304. Accordingly, as shown in FIG. 12, the second cup 504 and second arm 304 are located between the first cup 502 and the first arm 302. Therefore, to enable the cup assembly 306 includes an intermediate adapter 302A that passes through central portions of the second cup 504 and second arm 304 in order to connect the first cup 502 to the first arm 302. In particular, at a distal end, the adapter 302A has a number of openings 114 which correspond with openings 102 in the vertical cup mounting surface of the first arm 302 and enable the adapter to be mounted to the first arm. A plurality of prongs 110 extending outwards from a proximal end of the adapter 302A are configured to be inserted initially through the second aperture 120 of the second arm 304, then through the second central aperture 808 of the second cup 504 and then into the corresponding openings 112 in the first cup 502. This enables the second cup 504 and second arm 304 to be mated together and the first cup 502 and first arm 302 to be mated together without interference. In the discussion above and in the figures, the adapter 302A is a separate component from the first arm 302. However, in certain embodiments, the adapter may be formed as part of the first arm 302.

With reference to FIGS. 9 and 10, to assemble the gear hinge assembly 14, the first and second gears 310, 312 are initially mounted to the first and second cups 502, 504, respectively. First cup 502 is then inserted into the second cup 504. Next, the second arm 304 is mounted to the distal end of the second cup 304. Then the adapter 302A is inserted through the second cup 504 and second arm 304 and then into the first cup 502. The first arm is then mounted to the distal end of the adapter. Lastly, a bolt is inserted through the first aperture 104 in the first arm 302, through a third central aperture 810 in the adapter 302A, through the second aperture 120 in the second arm 304, through the second central aperture 808 in the second cup, through the first central aperture 804 in the first cup 502, and then secured in the threaded bore 602 in the carrier bushing 506.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

What is claimed is:

1. An adjustable bed comprising:

a first bedframe half;

a second bedframe half; and a gear assembly mounted to the first and second bedframe halves;

wherein the gear assembly is configured to laterally translate both bedframe halves while, simultaneously with the translation, rotating either the first bedframe half with respect to the second bedframe half or the second bedframe half with respect to the first bedframe half.

2. The adjustable bed of claim 1 further comprising an adapter configured to mount to the first arm and configured to mount to the first gear to connect the first arm to the first gear, wherein a portion of the adapter is inserted through a portion of the second arm and through a portion of the second gear before mounting to the first gear.

3. The adjustable bed of claim 1 wherein the first gear track and the second gear track are spaced laterally apart to form a neutral position.

4. The adjustable bed of claim 1, wherein the gear assembly further comprises a bolt and a stem configured for lateral movement, wherein the bolt is inserted into the first arm and then passes through the second arm, second gear, first gear and is threaded into the stem for moving the gear assembly in the first and second lateral directions.

5. The adjustable bed of claim 1 further comprising a housing disposed at a first end or a second end of the adjustable bed and wherein the gear assembly is located within the housing.

6. The adjustable bed of claim 5 wherein the housing comprises an elongate lateral aperture through which the gear assembly is secured to the bed halves.

7. The adjustable bed of claim 5 further comprising a bearing disposed on an outside surface of the gear assembly and configured to contact a portion of the housing.

8. The adjustable bed of claim 1 wherein the adjustable bed is a hospital-type bed having a plurality of articulating sections joined together by joints disposed laterally across the bed.

9. The adjustable bed of claim 1 wherein the bed comprises a first end and a second end and where a first gear assembly is mounted to the first and second bedframe halves at the first end and a second gear assembly is mounted to the first and second bedframe halves at the second end.

10. An adjustable bed comprising:

a first bedframe half;

a second bedframe half; and a gear assembly mounted to the first and second bedframe halves, the gear assembly having:

a first arm having a cup mounting surface and a bedframe mounting surface;

a second arm having a cup mounting surface and a bedframe mounting surface;

first and second nestable cups, each cup having a proximal end having an opening, a distal end having mounts, and a hollow interior, wherein the first cup is sized to nest concentrically to and substantially within the hollow interior of the second cup, the mounts of the first cup configured to mate with the mounting surface of the first arm and the mounts of the second cup configured to mate with the mounting surface of the second arm;

a first gear having an opening and disposed at the proximal end of the first cup;

a second gear having an opening and disposed at the proximal end of the second cup and oriented concentrically with and adjacent to the first gear;

a first gear track in alignment with teeth of the first gear;

a second gear track in alignment with teeth of the second gear;

a gear assembly configured for providing lateral movement to the gear assembly;

wherein moving the gear assembly in a first lateral direction causes the first gear to engage with the first gear track in order to rotate the first cup, first arm, and first bedframe half while the second arm does not rotate and wherein moving the gear assembly in a second lateral direction causes the second gear to engage with the second gear track to rotate the second cup, second arm and second bedframe half while the first arm does not rotate;

wherein the lateral movement of the gear assembly and the rotational movement of either the first bedframe half or the second bedframe half occurs simultaneously.

11. The adjustable bed of claim 10 wherein the gear assembly includes:

a motor mounted to the worm gear;

a threaded worm gear carrier threaded onto the worm gear;

a cylindrical carrier bushing mounted to the worm gear carrier and configured for insertion into an opening in a proximal end of the first gear.

12. The adjustable bed of claim 10 wherein the first gear track and the second gear track are offset from one another.

13. The adjustable bed of claim 10 further comprising an adapter mounted to the first arm and configured to mount to the first cup to connect the first arm to the first cup, wherein a portion of the adapter is inserted through a portion of the second arm and through a portion of the second cup before mounting to the first cup.

14. The adjustable bed of claim 10 further comprising an adapter configured for placement between a hub of the first and second arms and to join the first arm with the first cup, the adapter having:

a perimeter and a plurality of outer openings disposed adjacent the perimeter and configured to align with the plurality of outer openings of the first arm and to receive a plurality of connectors to mate the first arm to the adapter;

a plurality of dowels configured to be inserted through the second aperture of the second arm, through the opening of the second cup, and into the mounts of the first cup to mate the first cup to the adapter.

15. An adjustable bed comprising a first bedframe half;

a second bedframe half;

a gear assembly comprising:

an L-shaped first arm having:

a vertical cup mounting surface having a shoulder connected to a hub having a perimeter, a plurality of outer openings disposed adjacent the perimeter of the hub and a first aperture centrally located in the hub;

a horizontal platform mounting surface extending orthogonally away from a bottle edge of the shoulder and having a plurality of openings, the platform mounting surface configured to mount to a bottom surface of the first bedframe half;

an L-shaped second arm having:

a vertical cup mounting surface having a shoulder connected to a hub having a perimeter and a second aperture centrally located in the hub, a plurality of outer openings disposed adjacent the perimeter of the hub;

a horizontal platform mounting surface extending orthogonally away from a bottle edge of the shoulder and having a plurality of openings, the platform mounting surface configured to mount to a bottom surface of the second bedframe half;

first and second nestable cups, each cup having a proximal end having an opening, a distal end having mounts, and a hollow interior, wherein the first cup is sized to nest concentrically to and substantially within the hollow interior of the second cup, and wherein the mounts of the second cup and the outer openings of the second arm are configured to align and to receive connectors in order to be mated together;

an adapter configured for placement between the hub of the first and second arms and to join the first arm with the first cup, the adapter having:

a perimeter and a plurality of outer openings disposed adjacent the perimeter and configured to align with the plurality of outer openings of the first arm and to receive a plurality of connectors to mate the first arm to the adapter;

a plurality of dowels configured to be inserted through the second aperture of the second arm, through the opening of the second cup, and into the mounts of the first cup to mate the first cup to the adapter;

a first gear having an opening and disposed at the proximal end of the first cup;

a second gear having an opening sized to encircle the first cup, the second gear disposed at the proximal end of the second cup and adjacent the first gear;

a first gear track in alignment with teeth of the first gear;

a second gear track in alignment with teeth of the second gear and offset from the first gear track;

a gear assembly configured for providing lateral movement to the gear assembly, the gear assembly having a stem sized for insertion into the opening of the first gear and to be inserted into the hollow interior of the first cup;

wherein moving the gear assembly in a first lateral direction causes the first gear to engage with the first gear track in order to rotate the first cup, first arm, and first bedframe half while the second arm does not rotate and wherein moving the gear assembly in a second lateral direction causes the second gear to engage with the second gear track to rotate the second cup, second arm, and second bedframe half while the first arm does not rotate;

wherein the lateral movement of the gear assembly and the rotational movement of either the first bedframe half or the second bedframe half occurs simultaneously.

16. The adjustable bed of claim 15 wherein the gear assembly comprises:

a laterally disposed worm gear;

a motor mounted to the worm gear;

a threaded worm gear carrier threaded onto the worm gear; and a cylindrical carrier bushing mounted to the worm gear carrier and configured for insertion into an opening in a proximal end of the first gear.

* * * * *